US006038785A

United States Patent [19]

Lawson et al.

[11] Patent Number: 6,038,785

[45] Date of Patent: Mar. 21, 2000

[54] VACUUM DRYING SCREEN

[76] Inventors: Richard R. Lawson, 4305 Greilick Rd., Traverse City, Mich. 49686; Roger C. Droukas, 601 Grand Ave., Thiensville, Wis. 53092

[21] Appl. No.: 09/007,954

[22] Filed: Jan. 16, 1998

[51] Int. Cl.[7] ..... F26B 9/04

[52] U.S. Cl. ..... 34/145; 34/143; 34/92; 100/90; 100/325

[58] Field of Search ..... 34/90, 92, 143, 34/145, 587, 588, 615, 619, 622, 635; 69/48; 422/57, 35; 100/90, 106, 325, 326

[56] References Cited

U.S. PATENT DOCUMENTS

| | | | |
|---|---|---|---|
| 4,438,570 | 3/1984 | Dokoupil . | |
| 5,056,239 | 10/1991 | Corner | 34/92 |
| 5,860,222 | 1/1999 | Leander | 34/90 |

*Primary Examiner*—Pamela A. Wilson

*Attorney, Agent, or Firm*—Waters and Morse, P.C.

[57] ABSTRACT

A vacuum dryer panel for a leather drying machine wherein a dryer panel comprising a porous screen is mounted over a perforated plate on the underside of a vacuum chamber positioned above a heated drying table on which leather skins are dried. The dryer panel comprises a layer of fine mesh screen preferably formed of a synthetic resin material mounted on a porous backing preferably formed of a synthetic resin material. The backing material is adapted to be mounted adjacent an outer side of the perforated plate and provides porosity between the screen and adjacent openings of the perforated plate. The backing material is sufficiently rigid to prevent the screen material from being pulled into openings in the perforated plate by a negative pressure on the upper side of the plate, so as to prevent marks in the dried leather. The edges of the dryer panel are folded over and incorporate reinforcing strips. Threaded fasteners fit through spaced openings in the edges for mounting the dryer panel to a vacuum chamber. The fasteners can be tightened to increase the outward tension on the dryer panel.

7 Claims, 3 Drawing Sheets

VACUUM DRYING SCREEN

BACKGROUND OF THE INVENTION

In leather tanning operations, it is necessary to quickly dry wet leather. To do this, the wet leather skins are spread out on a metal drying table and the surface of the table is heated from underneath by hot water. To accelerate the drying of the leather, a vacuum chamber having a porous or permeable lower surface is placed on top of the table with the porous surface (typically a stainless steel screen) being positioned against the wet leather. When a vacuum is drawn in the vacuum chamber, this creates a lower pressure area adjacent the leather and induces more rapid vaporization of the water vapor in the leather. In most operations, a leather drying machine may include a number of drying tables, with the underside of each drying table serving a dual function as the vacuum chamber. A typical drying table may be about six inches thick and have a stainless steel top surface and a stainless steel screen on the bottom surface, with a horizontal partition dividing the table into an upper water chamber and a lower vacuum chamber.

The problem with these tables is that the stainless steel screens are extremely expensive. A single stainless steel screen may cost $4,000, and a single drying machine may employ five or more screens. The screens are durable but not infrequently are destroyed by mishandling.

An object of the present invention is to provide a less expensive but effective dryer panel screen for a leather drying machine.

DETAILED DESCRIPTION OF THE PREFERRED EMBODIMENTS

Figure 1:
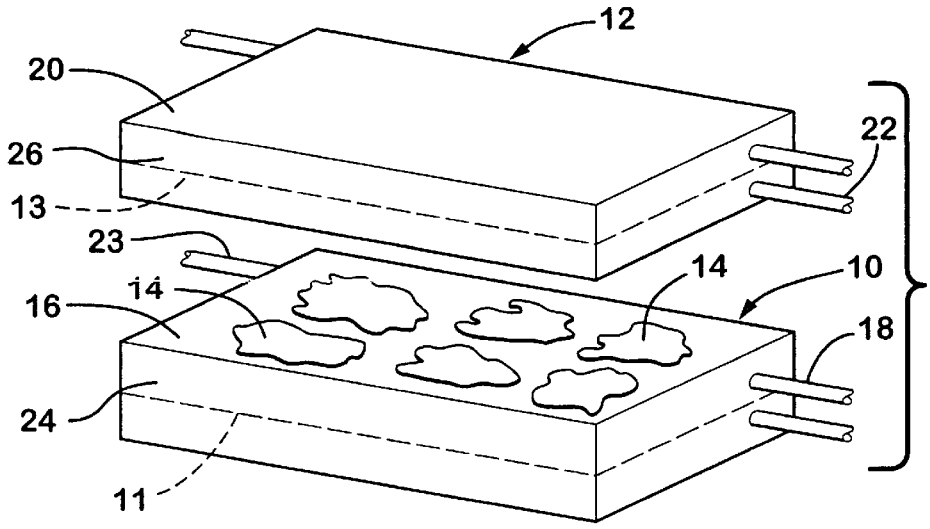
FIG. 1 is a perspective view showing a leather drying table with a second leather drying table (with an interior vacuum chamber) spaced above the first table.
Figure 2:
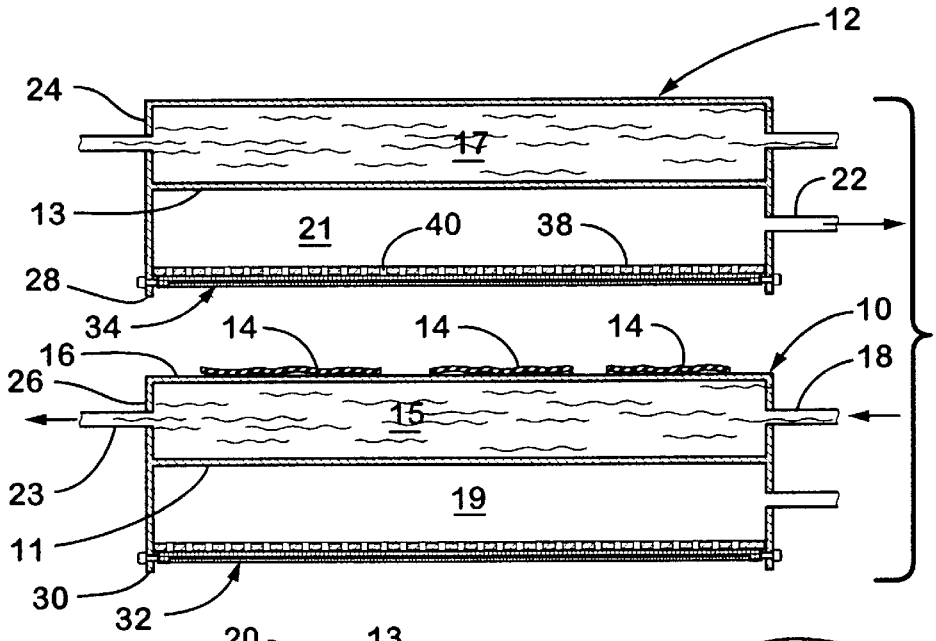
FIG. 2 a sectional side view of the apparatus of FIG. 1.

Referring to the drawings, a pair of drying tables 10 and 12 are shown in FIG. 1, with drying table 10 having leather skins 14 spread smoothly on an upper surface 16 thereof. The leather skins are wet and contain a substantial amount of moisture. Tables 10 and 12 are divided by horizontal partitions 11 and 13 respectively into upper water chambers 15 and 17 and lower vacuum chambers 19 and 21. Surface 16 of table 10 is heated by hot water through one or more inlets 18 in the side of the table. The water chamber also may have an outlet 23 for cooled water. Table 12 is substantially the same as table 10 and is positioned in a drying machine apparatus of conventional design. Table 12 has a stainless steel upper surface 20 and a vacuum outlet 22 from the open interior of the vacuum chamber of the table. Table 12 will first serve as a vacuum drying apparatus as shown in these drawings, but at a later stage in the machine operation table 12 will serve as a heating table and another dual purpose table will serve as the vacuum chamber for table 12. While not described in detail herein the water chambers and vacuum drying chambers and apparatus of both tables are identical.

Figure 3:
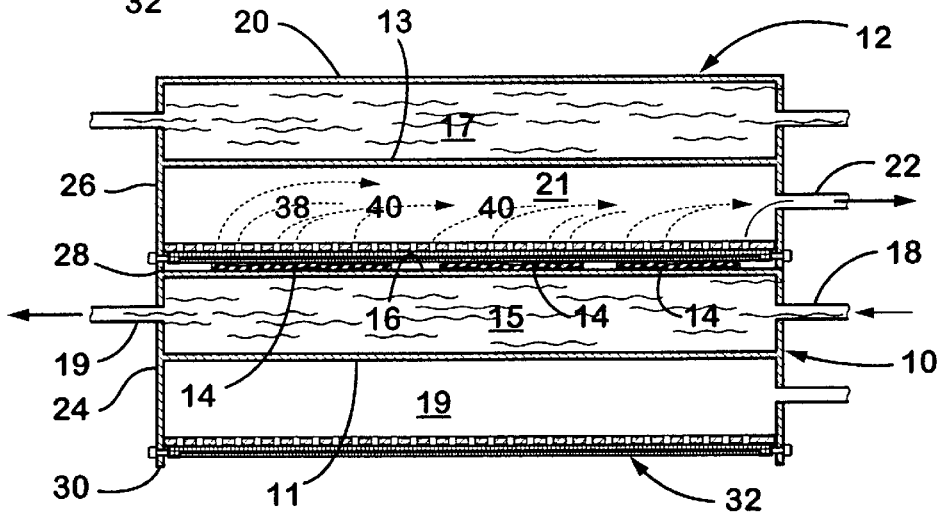
FIG. 3 is a sectional side view of the apparatus of FIG. 1, shown with the vacuum chamber in engagement with the leather on the top of the drying table.

Tables 10 and 12 respectively have sidewalls 24 and 26 extending downwardly from the tops of the tables to lower ends 28 and 30 (see FIG. 3), which may include vacuum seals. These ends, which are shown only schematically in the drawings, extend around the periphery of the table. The lower side of the vacuum chamber in each table is covered by a perforated plate 38, which is spaced above the lower ends. The perforations provide the inlet to the vacuum chamber in table 12 (as well as table 10)

Identical dryer panels 32 and 34 constructed in accordance with the present invention are mounted over perforated plate 38 in tables 10 and 12.

Figure 4:
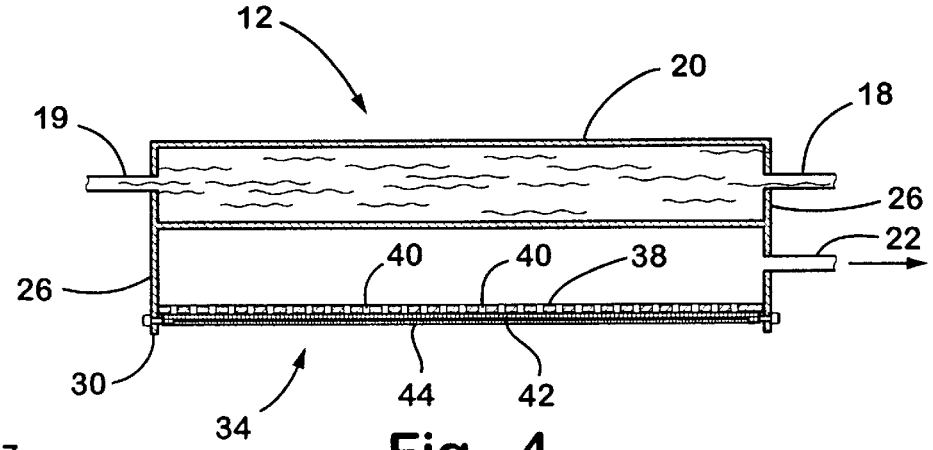
FIG. 4 is an enlarged side elevational view of one of the drying tables and vacuum chamber of the present invention.

A more detailed view of the construction of table 12 is shown in FIG. 4. It should be understood that the tables are shown schematically in the present invention and that tables 12 and 10 are substantially the same. The construction of the tables themselves is conventional.

Perforated stainless steel plate 38 covers the open bottom of table 12, with the plate being welded or the like to the sides of the table at a position spaced upwardly from the lower ends of the sidewalls. Plate 38 is perforated with a series of openings 40 that are approximately ¼ inch in diameter. This is conventional table construction.

In accordance with the present invention, dryer panel 32 comprises a two layer panel, with an upper layer 42 comprising a porous sheet material having some structural stiffness and a lower layer 44 comprising a fine mesh screen. Desirably, sheet 42 comprises a fabric formed of a synthetic resin, such as a monofilament polypropylene twill fabric. This serves as a backing panel for the lower layer of the dryer panel 44 which comprises a fine mesh screen formed of a synthetic resin. Desirably a 50 mesh nylon screen is employed.

Figure 5:
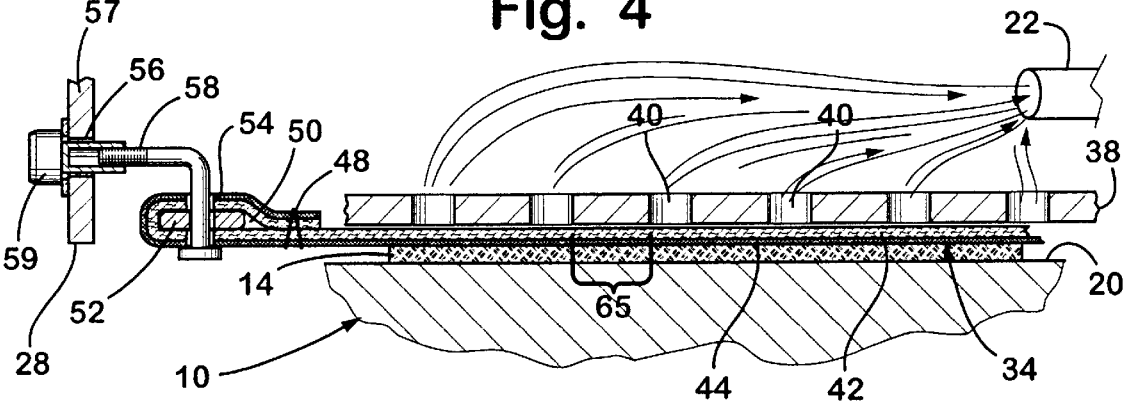
FIG. 5 is an enlarged, sectional view showing the dryer panel attached to a vacuum chamber.

As shown in FIG. 5, the ends of the panel are folded over to form a top layer 46 that is sewn or otherwise fastened to the backing panel at an inner edge 48. A two inch double stitched hem is desirable. This leaves an elongated opening or slot 50 along the peripheral edge of the panel. Stainless steel reinforcing strips 52 are slid into the openings 50 for providing edge rigidity to the panels. The stainless steel strips are preferably 18 gauge stainless steel and approximately ¾ inches wide. The panel itself is typically 10 feet wide and 20 feet long. Holes 54 are formed at 6 to 12 inch spacings along the outer periphery of the panel, and these holes are positioned adjacent to holes 56 in the rim 57 at the lower ends of the sidewalls of the table. L-shaped fasteners 58 extend through holes 54 and 56 to fasten the screen in place on the bottom of the table. Threaded ends of the fasteners extend through holes 56 and are held in place by nuts 59. Preferably the nuts are allen headed cap screws. The tension on the screen can be adjusted by tightening or loosening the nuts.

With the screen in place, and table 12 moved into a position where it presses against the upper surface of leather pieces 14, a vacuum is drawn through vacuum outlet 22, creating a lower pressure zone immediately above the heated, wet leather. The lower pressure induces accelerated water vaporization from the leather and enhances substantially the drying time of the leather.

As shown in FIG. 5, screen 44 actually contacts leather 14. Screen 44, being a fine mesh nylon screen, however, is quite flexible. Porous backing material 42 provides rigidity to the screen 44 while still permitting the panel to be porous. Backing 42 provides a more rigid material for contact with stainless plate 38 and prevents the nylon mesh screen from being sucked into openings 40 in the stainless steel plate by the vacuum drawn in the vacuum chamber. Without the backing material, the screen itself can be drawn into the openings, and this leaves small round marks on the leather, which is undesirable.

In addition to providing rigidity to the nylon mesh screen, the fabric backing material provides an air channel for air flow laterally across the non-porous surface of the plate 38 between the fine mesh screen and the plate and between the openings 40. In FIG. 5, this area is shown by numeral 65. Layer 42 provides a porous spacer between plate 38 and screen 44 so that vapor can pass through the screen in area 65 and then traverse in a sideways direction to opening 40 where it will be drawn through outlet 22. Layer 42 thus prevents the nylon screen from becoming matted against the plate 38 so as to impede air flow through the portions 56 of the screen between the openings 40.

Figure 6:
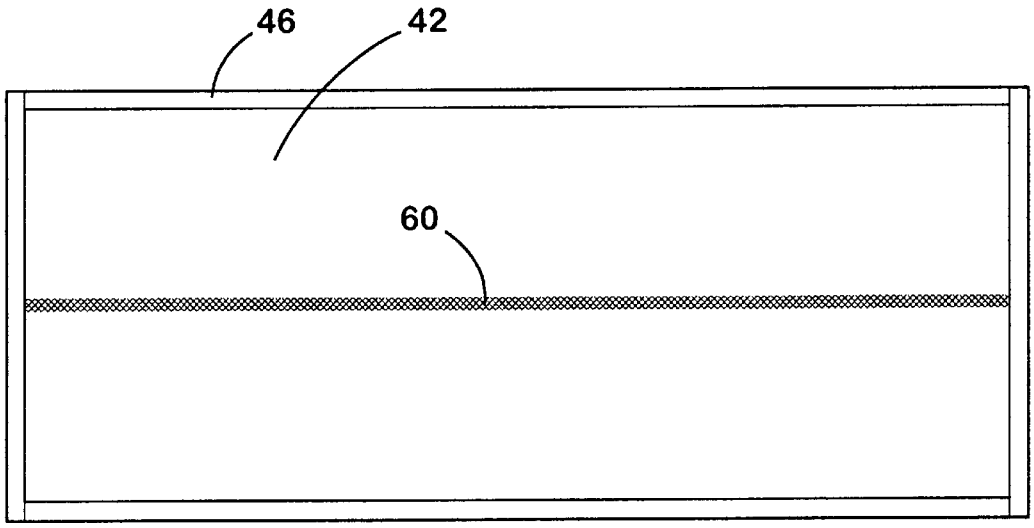
FIG. 6 is a plan view of a dryer panel constructed in accordance with the present invention.
Figure 7:
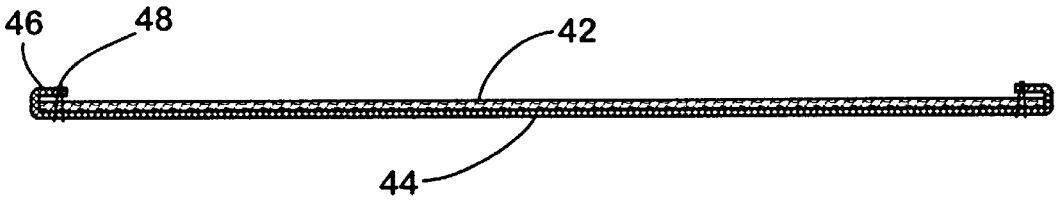
FIG. 7 is an edge view of a dryer panel in accordance with the present invention.

In constructing the screen, the backing material desirably is formed in a single panel, which is typically ten feet wide by twenty feet long. However, for some applications the backing material can be provided in two five foot strips, with the strips being bonded or sewn together at the center to form a seam 60 as shown in FIG. 6. It is important that the nylon screen be in one continuous fabric and not be provided with a seam. A seam in the nylon screen material can form a mark on the leather.

The present invention provides an improved, much less expensive dryer panel for a vacuum drying apparatus, which reduces substantially the cost of operating a vacuum drying machine. While much less expensive, the dryer panel of the present invention is quite durable and long lasting.

Another advantage of the present invention is that the dryer panel is formed of easily washable synthetic resin materials. The panel can be washed even while the panel is in the drying apparatus and permits a rapid changeover of the machinery for use with different colored leathers.

It should be understood that various modifications may be made in the arrangements and details of construction of the present invention without departing from the spirit and scope of the present invention.

We claim:

1. In a leather drying machine wherein a dryer panel comprising a porous screen is mounted over a perforated plate on the underside of a vacuum chamber that is positioned above a heated drying table on which leather skins are dried, the improvement wherein the dryer panel comprises a layer of fine mesh screen formed of a synthetic resin material mounted on a porous backing material, the backing material being adapted to be mounted adjacent an outer side of the perforated plate, the backing material providing porosity between the screen and adjacent openings of the perforated plate and resisting the screen material from being pulled into openings in the perforated plate by a negative pressure on the upper side of the plate, so as to prevent marks in the dried leather.

2. A vacuum dryer panel according to claim 1 wherein the backing material maintains the screen in a relatively flat position when the screen and backing material are placed against the perforated plate and a partial vacuum is drawn through the openings, the backing material providing transverse as well as lateral porosity that liquid and vapor can be drawn through the screen at a position opposite a solid portion of the perforated plate between openings in the perforated plate, the liquid and vapor being able to travel transversely to the plane of the screen as well as along the plane of the screen in the backing material in order to travel from the screen to the openings in the perforated plate.

3. A dryer panel according to claim 2 wherein the backing material comprises at least one of woven and non-woven fabric.

4. A dryer panel according to claim 3 wherein the backing panel is formed of a monofilament polypropylene twill fabric.

5. A dryer panel according to claim 1 wherein the screen comprises a nylon mesh screen having a porosity of approximately 50 mesh and the backing material comprises a fabric having the characteristics of a monofilament polypropylene twill fabric.

6. A dryer panel according to claim 5 wherein the dryer panel is generally rectangular and is folded over and stitched at the edges, forming an enclosed space between the folded material at the edges, a reinforcing strip being enclosed in the enclosed space and extending along the peripheral edges of the panel, the edges of the panel having a series of spaced openings therein that extend through the folded material and the reinforcing strips, tightenable fasteners being attached to the panel through the openings and extending outwardly to and being attached to an adjacent position of the vacuum chamber, the fasteners being tightenable to increase outward tension on the edges of the panel in the plane of the panel.

7. A dryer panel according to claim 6 wherein the vacuum chamber has a peripheral rim positioned adjacent to the periphery of the panel, the rim having spaced fastener openings positioned adjacent the openings in the edges of the panel, the fasteners engaging the vacuum chamber through the openings in the rim, the fasteners being threaded fasteners that can be tightened by rotating one element of the fasteners.

* * * * *